United States Patent [19]

Hosokawa

[11] 4,365,940

[45] Dec. 28, 1982

[54] ROTARY PISTON PUMP OF AXIAL TYPE

[76] Inventor: Toshio Hosokawa, 6-1-303 Kanamachi 1-chome, Katsushika-ku, Tokyo, Japan, 125

[21] Appl. No.: 190,866

[22] PCT Filed: Apr. 24, 1979

[86] PCT No.: PCT/JP79/00105

§ 371 Date: Feb. 14, 1980

§ 102(e) Date: Feb. 7, 1980

[87] PCT Pub. No.: WO80/00096

PCT Pub. Date: Jan. 24, 1980

[30] Foreign Application Priority Data

Jun. 14, 1978 [JP] Japan ..... 53-70973
Jan. 17, 1979 [JP] Japan ..... 54-3067

[51] Int. Cl.[3] ..... F04B 1/18

[52] U.S. Cl. ..... 417/269; 91/507; 74/60

[58] Field of Search ..... 123/58 R, 58 A, 43 A, 123/58 AA, 58 AM; 417/269, 271; 91/507, 499; 74/60, 53

[56] References Cited

U.S. PATENT DOCUMENTS

| | | | |
|---|---|---|---|
| 643,918 | 2/1900 | Textorius | 417/269 |
| 1,521,364 | 12/1924 | Froelich | 417/269 |
| 1,661,582 | 3/1928 | Szydlowski | 74/53 |
| 2,669,185 | 2/1954 | Tallis | 417/269 |
| 3,598,094 | 8/1971 | Odawara | 123/43 A |
| 3,663,226 | 5/1972 | Biermann | 92/71 |

*Primary Examiner*—William L. Freeh
*Attorney, Agent, or Firm*—McGlew and Tuttle

[57] ABSTRACT

A rotary piston pump of the axial type with fixed cylinders wherein a flywheel of rotary drum shape is anchored to a driving shaft (1) coaxially, on the circular side of said wheel being engraved one continuous oblique groove which takes the form of one cycle sine curve on the development view of the circular side, while outer ends of piston rods of pistons in the cylinders are connected with the oblique groove. The pistons or plungers thus repeat reciprocation with rotation of the driving shaft.

According to the present invention, an apparatus of large scale having relatively few sliding faces in its parts may be designed. Further, according to the present apparatus, besides oil, the operating fluids of low lubricity, e.g., water and the like, may also be used.

10 Claims, 7 Drawing Figures

ROTARY PISTON PUMP OF AXIAL TYPE

DESCRIPTION

1. Technical Field

The present invention relates to a rotary piston pump, and more particularly to a rotary piston pump of the axial type. There have hitherto been known rotary piston pumps of the radial type in which the pistons are arranged vertically to the driving shaft and of the axial type in which the pistons are arranged in parallel with the driving shaft. Each of these two types further have rotatable cylinders or fixed cylinders. The present invention relates to a novel rotary piston pump of the axial type with fixed cylinders.

2. Background Art

The conventional rotary piston pump of the axial type with fixed cylinders has been, for example, so constructed as a plurality of cylinders are arranged symmetrically around the driving shaft, to which the disk inclined with predetermined angle to the vertical plane to said shaft is anchored coaxially. Outer ends of piston rods or plungers fit in said cylinders and closely contact the corresponding side of said inclined disk, whereby the plungers or pistons repeat reciprocation through the inclined disk with the rotation of the driving shaft, resulting in alternative operation of the suction valves and delivery valves both set in the cylinders (see for example, Handbook of Hydraulic Mechanical Engineering, Revised Edition, pages 443–447, published by Corona Publishing Co., Ltd., on Feb. 20, 1972).

The conventional apparatus as above has advantages that it can be designed compactly and that it may be applied to a high pressure system with good efficiency, however, it has, on the other hand, such disadvantages that strict accuracy is required in the sliding faces and in sealing parts included in the apparatus and further that the operating fluids of low lubricity such as water and the like cannot be applied thereto.

Disclosure of Invention

The present invention resides in the rotary piston pump of the axial type with fixed cylinders, wherein a plurality of cylinders are arranged symmetrically around and in parallel with the driving shaft. The pistons or plungers are fitted in these cylinders and repeat reciprocation with rotation of the driving shaft so that the fluid suction valves and delivery valves in the cylinders operate alternatively. The invention is characterized in that a flywheel of rotary drum shape is coaxially anchored to the drive shaft, on the circular side of which flywheel is engraved one continuous oblique groove taking the form of one cycle sine curve on the development view of said circular side, while the outer ends of the piston rods of pistons or of plungers are connected with said oblique groove.

According to the apparatus of the present invention, the flywheel of rotary drum shape is employed as a main driving mechanism so that large scale apparatus may be designed. Further, according to the apparatus of the invention, apparatus with a few sliding faces in its parts can be designed. Moreover, in the apparatus, besides oil, the operating fluids having low lubricity, e.g., water and the like, may also be applied thereto.

BRIEF DESCRIPTION OF DRAWINGS

Each of FIGS. 1 and 2 is a vertical sectional view of a preferred embodiment of the apparatus according to the present invention, which view includes the axes of the corresponding piston rod and driving shaft and in which the oblique groove of the flywheel appears at the end of a circular side of said wheel (providing that the oblique groove is simply shown straight in the lengthwise direction).

BEST MODE FOR CARRYING OUT THE INVENTION

Figure 1:
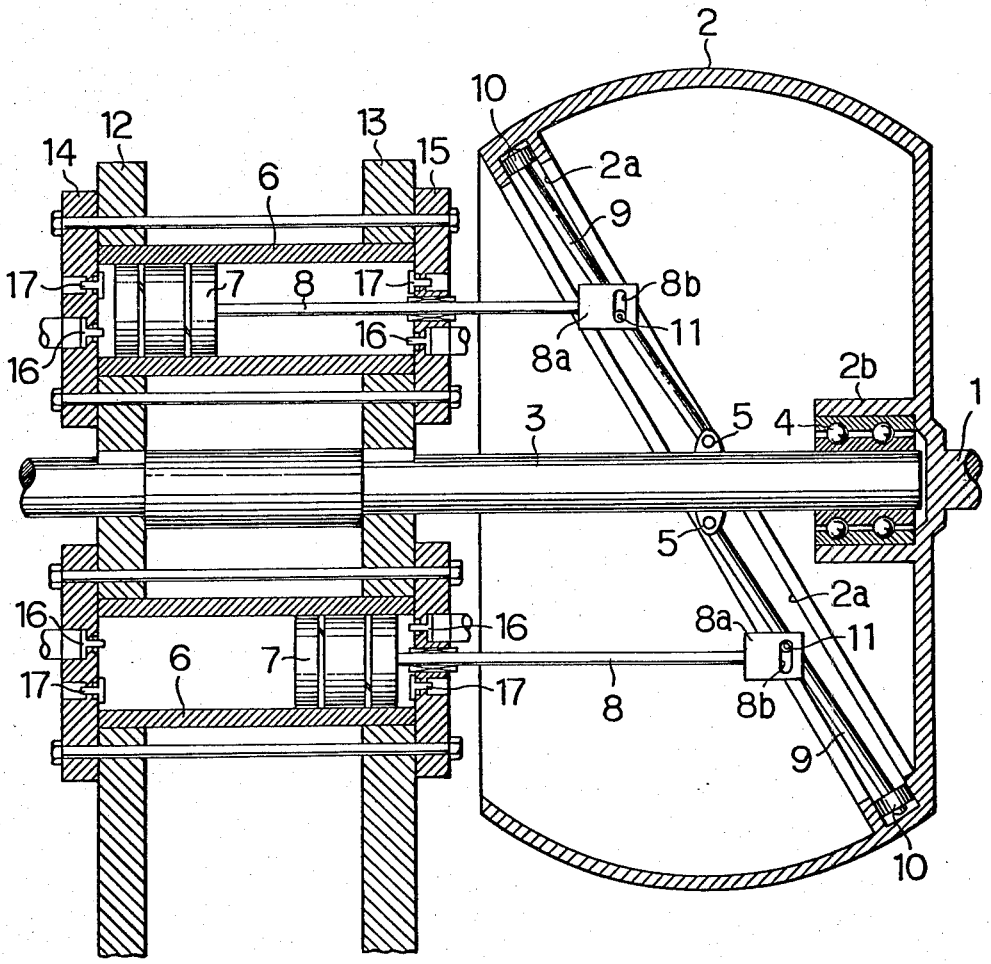
Figure 3:
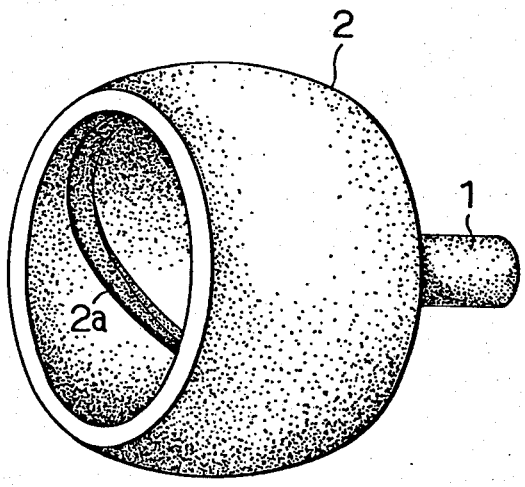
FIGS. 3 and 4 illustrate perspective views of the flywheels of the apparatus in FIGS. 1 and 2, respectively.
Figure 5:
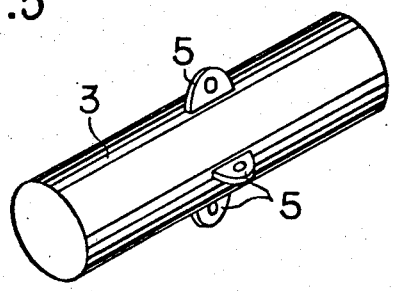
FIG. 5 illustrates a fragment of enlarged perspective view of the fixed shaft of the apparatus in FIG. 1.
Figure 6:
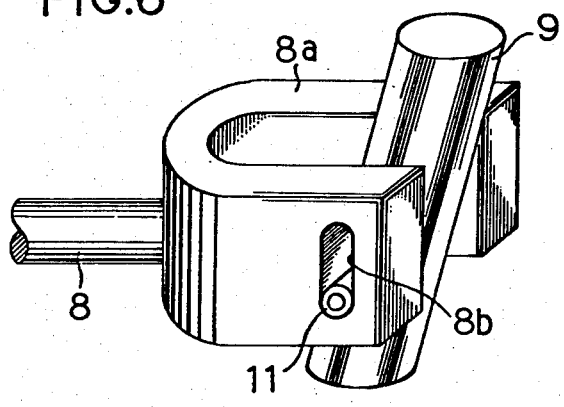
FIG. 6 illustrates an enlarged perspective view of the connecting portion of the end grip of a piston rod with the intermediate part of the lever of the apparatus in FIG. 1.

Referring to FIG. 1, a driving shaft 1 of the pump, and a flywheel 2 of rotary drum shape which is anchored to driving shaft 1 coaxially and which is so made as its left side is open while its circular side takes the form of an arc, are shown. Inside the circle of flywheel 2 is engraved one continuous oblique groove 2*a* taking the form of, on the development view of such circular side, one cycle sine curve which the amplitude coming to the width in upper and lower directions of the same development view (see FIG. 3). The inside of this oblique groove 2*a* takes the form of shadow rectangle on its vertical section. A fixed shaft 3 installed coaxially in flywheel 2, is provided, the right end of which shaft 3 is fitted rotatably, through bearings 4, in cylindrical bearing housing 2*b* having been fixed coaxially to flywheel 2. A plurality of hinges 5 are installed around the circular side of fixed shaft 3 symmetrically and radially so that each of them is positioned in the rotation center of said circular arc of flywheel 2 (see FIG. 5). Cylinders 6 are arranged symmetrically around and in parallel with fixed shaft 3, and pistons 7 are fitted slidably in cylinders piston rods 8 fixed to pistons 7 have outer end grips 8*a*, as shown in FIG. 6, formed so as to have a U-shape (or forked shape). Two opposite oval openings 8*b*, 8*b* are bored into grips 8*a*. On the other hand, the base ends of levers 9, are connected with said hinges 5, respectively, the other ends of which levers 9, are fitted in oblique groove 2*a* of the flywheel by means of rollers 10, installed rotatably at said ends of the levers through bearings inserted in the same groove 2*a* in the form of roller bearings. The intermediate of each lever 9 is placed inside the U-shape member of outer end grip 8*a* of each piston rod, and both projecting ends of minor roller 11 which are fitted rotatably in the corresponding portion of lever 9 through bearings, are inserted loosely in openings 8*b*, 8*b* at the outer end grip of each piston rod. Piston rod 8 is thus connected with lever 9. Frames 12 and 13 are shown, which support cylinders 6 and valve supporting plates 14 and 15 are installed closely outside the frames 12 and 13, while delivery valves 16 and suction valves 17 open into corresponding portions of plates 14 and 15. Frames 12 and 13 are anchored to fixed shaft 3 or to an appropriate fixed base, and frames 12, 13 as well as valve supporting plates 14, 15 are incorporated in one body through long bolts.

The operation of the apparatus in FIG. 1 is as follows: when flywheel 2 rotates with driving shaft 1, the other end of lever 9 supported by oblique groove 2*a* through roller 10 repeats pendulum-like reciprocation from the left end to the right end of the circular side of flywheel 2 and vice versa, on the plane including the sheet face of FIG. 1 or the axes of lever 9 and driving shaft 1, centering around its connecting point with the corresponding hinge 5 on fixed shaft 3. Accordingly, piston rod 8 interlocked with the intermediate portion of lever 9 through minor rollers 11 repeats also reciprocation on the same plane as above, i.e., the plane including the axes of piston rod 8 and driving shaft 1. In the above, both projecting ends of minor rollers 11 of lever 9 reciprocate up-and-down motion within openings 8*b*, 8*b*, the amplitude of which motion refers to the width in upper and lower directions of the locus drawn by minor rollers 11 travelling around the connecting point of lever 9 with corresponding hinge 5. That is, the length in upper and lower directions of said openings 8*b*, 8*b* is made to be longer than the width in upper and lower directions of a travelling locus of minor rollers 11. Thereafter, piston 7 fixed to piston rod 8 moves, in the routine manner, to left or right, namely, from its upper dead point to its lower dead point, and vice versa, whereby the operating fluid is sucked from suction valve 17 and delivered from delivery valve 16 alternatively.

Figure 2:
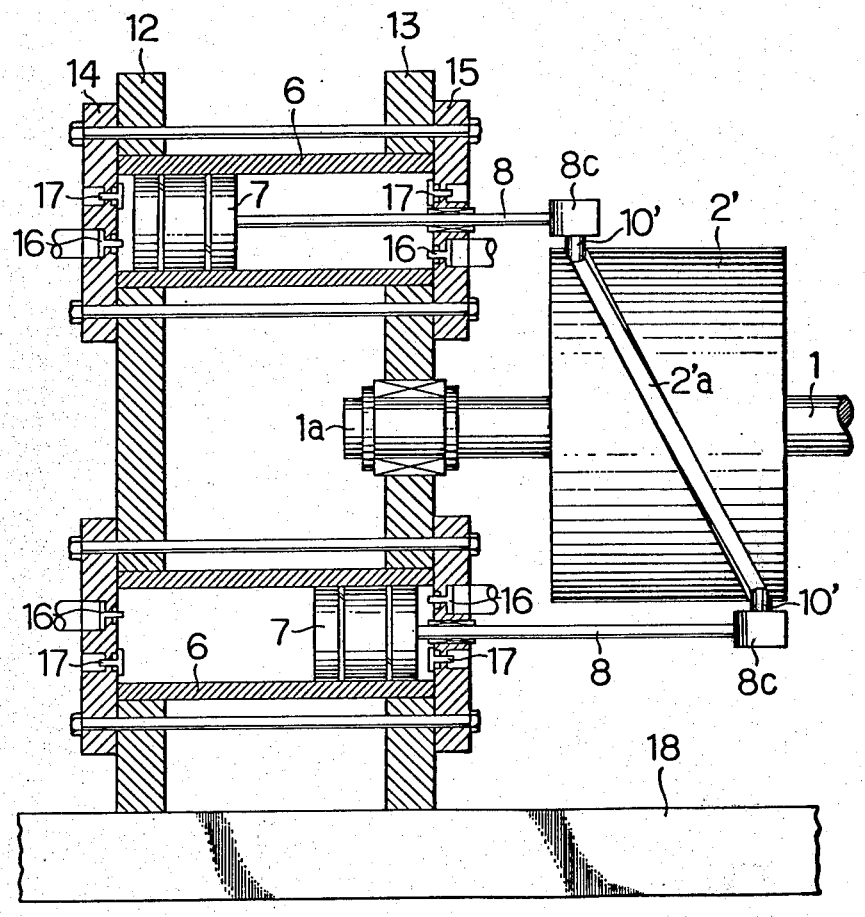
Figure 4:
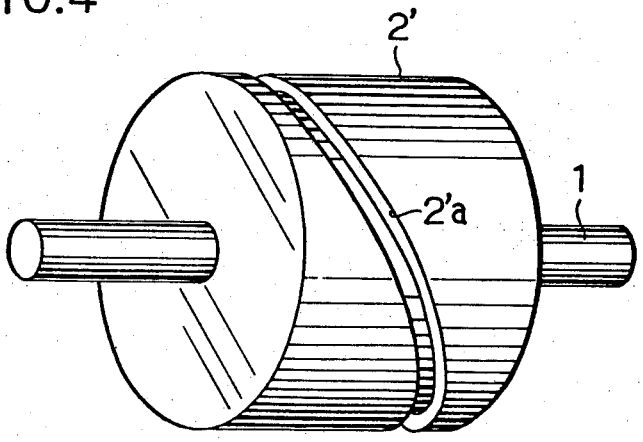
Figure 7:
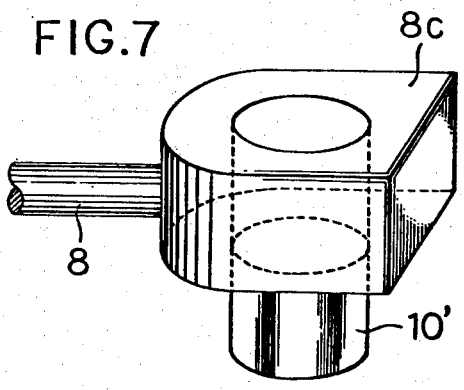
FIG. 7 illustrates an enlarged perspective view of the end grip of a piston rod of the apparatus in FIG. 2.

FIG. 2 illustrates another preferred embodiment of the present invention, which differs from the apparatus in FIG. 1 in the construction of the flywheel as well as the connecting manner of the piston rods with the oblique groove on the circular side of such flywheel. In FIG. 2*a* flywheel of rotary drum shape 2′ takes the form of a cylinder and has an outer surface on which is engraved an oblique groove 2′*a* (see FIG. 4). The groove is vertical to the axis of driving shaft 1 and, as shown in FIG. 7, receiver rollers 10′ of end grips 8*c* of the piston rods 8. Rollers 10 are rotatably mounted to grips 8*c*′ through bearings and are fitted rotatably in said oblique groove 2′*a* of flywheel 2′ in the form of roller bearings. The produced portion 1*a* of the axis of driving shaft 1 is supported by frame 13. 18 shows a common bed of frames 12 and 13. The numerals and their meanings of the other members of the apparatus than the above-mentioned are the same as those of the corresponding members in FIG. 1.

Explaining the operation of the apparatus in FIG. 2, when flywheel 2′ rotates piston rod 8 connected with oblique groove 2′*a* through roller 10′ repeats reciprocation from left to right and vice versa, on the plane including the sheet face of FIG. 2 or the axes of said piston rod 8 and driving shaft 1. Thus, piston 7 moves to left or right in the same manner as in FIG. 1 so as to operate suction valve 17 and delivery valve 16.

In the apparatus in FIGS. 1 and 2, the inside of oblique grooves 2*a* and 2′*a* of flywheel 2 may, on their vertical section, take other forms than that of a rectangle, with the proviso that roller 10 at the upper end of lever 9 or roller 10′ at outer end grip 8*c* of piston rod 8 will take the forms capable of fitting therein in the form of roller bearing. In the apparatus of FIG. 2, oblique groove 2′*a* is engraved outside the circle of flywheel 2′, however, it may be engraved inside flywheel 2′. That is, in such embodiment, the left side of flywheel 2′ will be open in the same manner as in FIG. 1 and each outer end grip 8*c* of piston rod 8 will be inserted through the open side (left side) of flywheel 2′ so as to fit the projecting end of roller 10′, which has been installed rotatably in said grip 8*c*, into oblique groove 2′*a* inside flywheel 2′. The embodiments of apparatus of the invention described in the above refer to the rotary pumps of double action type, however, those of single action type may readily be constructed by leaving out valve supporting plate 15 therefrom. Further, pistons 7, 7, with piston rods 8 may, of course, be replaced by plungers which herein will also be referred to as pistons. Furthermore, in the apparatus of FIG. 1, it is not indispensable to connect driving shaft 1 with fixed shaft 3. As for the driving force required and the output thereby in the apparatus of the present invention, supposing the angle ($\theta$) formed between piston rod 8 and the tangent to the projection line of real (i.e., curved) oblique groove 2*a* or 2′*a* on the same vertical section of the apparatus as in FIGS. 1 and 2 which includes the axes of piston rod 8 and driving shaft 1 and in which the oblique groove 2*a* or 2′*a* of flywheel 2 or 2′ is represented at the end of circular side of said wheel 2 or 2′, the driving force required and output depend theoretically on said angle $\theta$ as well as the radius of flywheel 2. Generally, $\theta$ will be suitably 70–80 degrees, while the radius of flywheel 2 may be selected appropriately to the scale of the apparatus.

I claim:

1. A rotary pump of the axial type comprising:

a frame;

a drive shaft rotatably mounted with respect to said frame;

a plurality of cylinders arranged parallel to and distributed symmetrically around an axis of said shaft, connected to said frame;

a piston slidably mounted in each cylinder for axial reciprocal motion therein, each piston having a piston rod extending substantially axially therefrom;

valve means connected to each cylinder for supplying fluid to and from each cylinder with motion of each respective piston therein;

a flywheel of rotary drum shape coaxially connected to said drive shaft having a coaxial surface with respect to said shaft axis and an oblique groove extending around said surface, said flywheel having an open end for receiving each piston rod, said coaxial surface being an inner arc shaped surface of said flywheel which carries said oblique groove; and connecting means connecting each piston rod to said groove so that rotation of said shaft and flywheel axially moves each piston in its respective cylinder, said connecting means comprising a fixed shaft coaxial with said drive shaft, a hinge for each piston connected to said fixed shaft substantially at a center of a radius of curvature of said coaxial surface arc, a lever for each hinge having one end connected to said hinge for movement of a respective lever thereabout and an opposite end, a roller connected to each opposite end of each lever rotatably supported in said oblique groove, and a grip connected between each piston rod and an intermediate portion of a respective lever.

2. A rotary pump according to claim 1, wherein each grip comprises a U-shaped member having opposite oval openings, each lever having side projections at an intermediate portion thereof with a minor roller rotatably mounted on each side projection and engaged in a respective oval opening of a respective grip.

3. A rotary pump according to claim 2, wherein said oblique groove is in the form of a rectangle in an axial cross section thereof.

4. A rotary pump according to claim 2, wherein a length of said oval opening is longer than a locus of radial motion of a respective minor roller mounted in each oval opening.

5. A rotary pump according to claim 1, including a bearing housing extending coaxially of said drive shaft in said flywheel, an axial end of said fixed shaft rotatably mounted in said bearing housing.

6. A rotary piston according to claim 5, wherein said bearing housing is cylindrical in shape, with a rotatable bearing connected between said fixed shaft and an interior of said cylindrically shaped bearing housing.

7. A rotary pump according to claim 1, wherein said frame comprises a pair of frame elements connected to opposite axial ends of each cylinder.

8. A rotary pump according to claim 1, wherein said frame comprises a pair of frame elements connected to opposite ends of each cylinder, said fixed shaft connected to both of said frame elements.

9. A rotary pump according to claim 7, including a valve supporting plate connected over an end of each cylinder and to one of said frame elements, said valve means comprising at least one fluid suction valve connected to each supporting plate and at least one fluid delivery valve connected to each supporting plate.

10. A rotary pump according to claim 1, wherein a tangent of a projection line of the oblique groove makes an angle with a plane extending through said drive shaft and each respective piston rod axis of seventy to eighty degrees.

* * * * *